US005733030A

United States Patent [19]

Cohn et al.

[11] Patent Number: 5,733,030

[45] Date of Patent: Mar. 31, 1998

[54] LIGHT REFLECTOR

[76] Inventors: Michael Cohn, 1 Cypress Ct., Millbrae, Calif. 94030; David Zeidman, 2828 Newlands Ave., Belmont, Calif. 94002

[21] Appl. No.: 699,708

[22] Filed: Aug. 1, 1996

[51] Int. Cl.[6] ..... F21K 2/06

[52] U.S. Cl. ..... 362/34; 362/348; 362/349

[58] Field of Search ..... 362/34, 84, 159, 362/174, 253, 297, 346, 348, 349, 352, 353

[56] References Cited

U.S. PATENT DOCUMENTS

| | | | |
|---|---|---|---|
| Re. 35,132 | 12/1995 | Bay et al. | 362/34 |
| 851,627 | 4/1907 | Norton | 362/346 |
| 3,425,949 | 2/1969 | Rauhut et al. | 252/188.3 |
| 3,442,814 | 5/1969 | Sheehan | 252/188.3 |
| 3,500,033 | 3/1970 | Cole et al. | 240/2.25 |
| 3,900,728 | 8/1975 | Holcombe | 240/52 |
| 4,186,426 | 1/1980 | Gingras | 362/34 |
| 4,761,721 | 8/1988 | Willing | 362/348 |
| 5,446,629 | 8/1995 | Steiger et al. | 362/34 |

FOREIGN PATENT DOCUMENTS

| | | | |
|---|---|---|---|
| 3310862 | 9/1984 | Germany | 362/346 |

*Primary Examiner*—Y My Quach

[57] ABSTRACT

A light reflector comprised of a plurality of facets (16). Facet (16) has a reflective interior surface that concentrates and directs the light emitting from a light-stick (18). Facets (16) have exterior surfaces that can be imprinted with information. The plurality of facets (16) creates a large aperture (10). The concentrated and directed light travels through the large aperture (10). The light reflector has at a point end (12) an acceptance means and a holding means to position light-stick (18). The acceptance means is a plurality of slits (24) and a plurality of slit stops (22). The holding means is the frictional property of the reflector material. The holding means can be enhanced by the addition of an encircling band (20). The light reflector is a foldable, flexible, compactable device that can be repeatedly bent and manipulated without fracturing and separating along a plurality of facet edges (14). The light reflector can be laminated with a variety of plastic films on one surface, two surfaces or no surfaces.

19 Claims, 4 Drawing Sheets

Perspective view with a light-stick and an encircling band.

Perspective view without a light-stick

Perspective view with a light-stick

Perspective view with a light-stick and an encircling band.

Perspective view with a conical-shaped reflector with a light-stick and an encircling band.

LIGHT REFLECTOR

BACKGROUND—FIELD OF INVENTION

This invention relates to light reflectors, specifically to such reflectors that are for use with a chemiluminescent light-stick.

BACKGROUND—DESCRIPTION OF PRIOR ART

Certain chemical reactions produce the emission of light in a process known as chemiluminescence. A practical application of chemiluminescence is for illumination where incandescent, arc, or other potentially hazardous types of lighting are to be avoided. Chemiluminescent reactions generate illumination without producing high temperatures, electrical shock and other hazardous conditions.

Commercial products utilizing this technology are available in tubular form. The reactant chemicals are kept separate inside a plastic robe. Manipulation of the robe brings the chemicals into a mixture and produces the desired illumination. The tubular chemiluminescent products are referred to as light-sticks.

Heretofore, fixtures for light-sticks have been designed as permanently-attached wall units. U.S. Pat No. 5,446,629 to Steiger (Aug. 29, 1995) discloses a device intended to be permanently attached to a wall. The permanent nature of the appliance and its bulky, rigid design increase the production cost of individual units. The bulky design does not facilitate compact storage of a reflector and light-stick together. Compact storage is useful in residences, commercial properties, medical facilities, automobiles, watercraft, aircraft, emergency rescue operations, and compact, personal survival kits.

Heretofore, portable devices have been designed for emergency identification. U.S. Pat. No. 4,186,426 to Gingras (Jan. 29, 1980) discloses a device intended to be fastened to clothing and activated for the purpose of drawing attention to the person wearing the device. The light-stick in this instance is used primarily for attracting the attention of a would-be rescuer.

Neither of the aforementioned patents is the property of the portability of a light-stick combined with its potential for concentrated illumination. These patents fail to create a compact directable source of concentrated chemiluminescent light.

OBJECTS AND ADVANTAGES

Accordingly, several objects and advantages of our invention are:

a) to provide a light reflector (hereafter referred to as "reflector") to be used with a chemiluminescent light-stick (hereafter referred to as "light-stick");

b) to provide a reflector which can be handheld, set in place, and suspended;

c) to provide a reflector which holds a light-stick of any design and any manufacture;

d) to provide a reflector which concentrates and directs light emitted from a light-stick;

e) to provide a reflector which is flexible and collapsible for storage and packaging;

f) to provide a reflector which is brightly colored for ease of identification;

g) to provide a reflector with imprintable facets to describe the operation of the reflector and to display other important information;

h) to provide the ability to cluster a plurality of reflectors together for increased illumination;

i) to provide safe illumination for residences, commercial properties, medical facilities, automobiles, watercraft, aircraft, emergency rescue operations, and compact, personal survival kits;

j) to provide a reflector which can be portable;

k) to provide a reflector which can be stationary.

Further objectives, features, and advantages of the reflector will become apparent from a consideration of the drawings and the ensuing description of certain preferred embodiments.

DRAWING FIGURES

REFERENCE NUMERALS IN DRAWINGS

Figure 1:
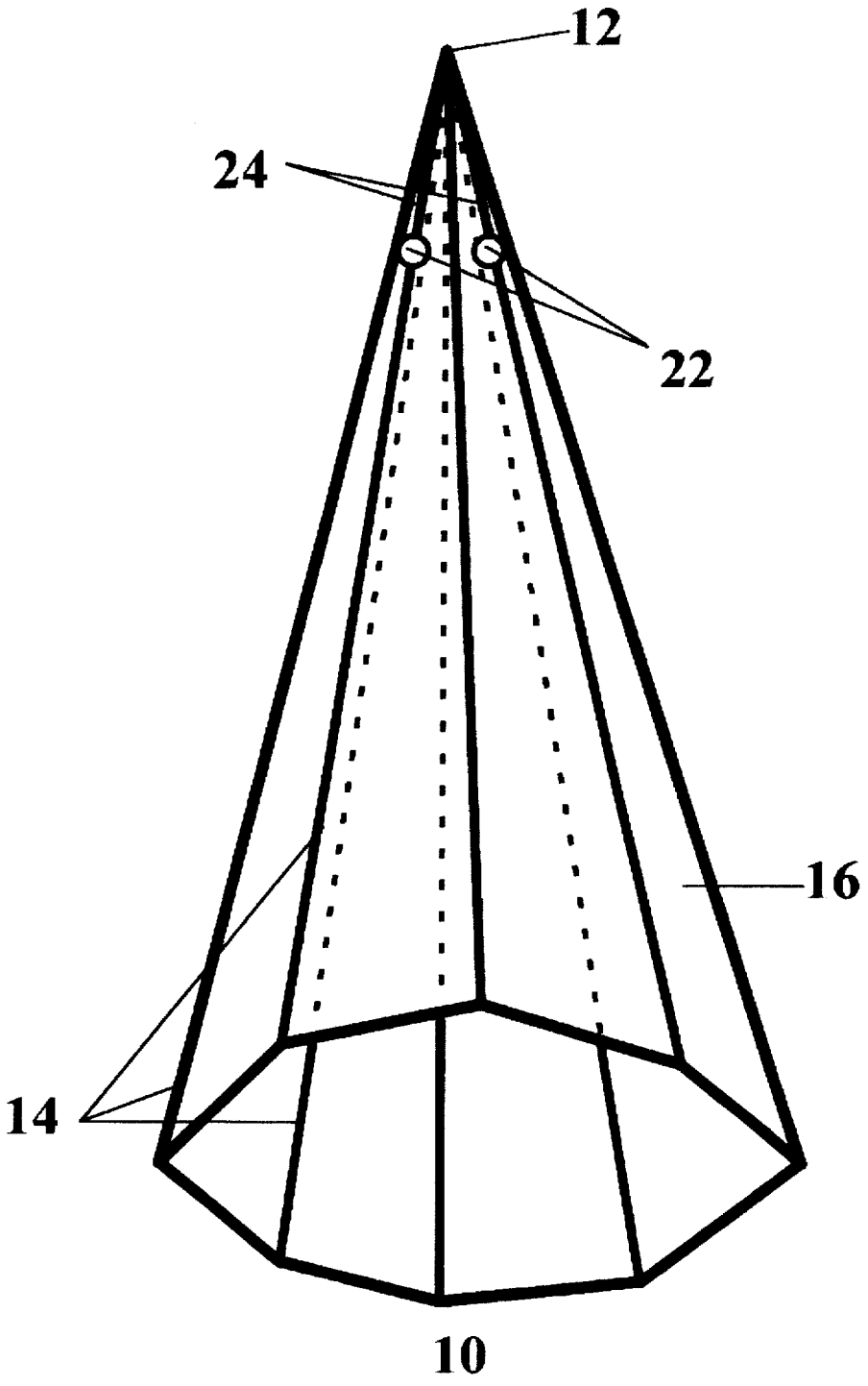
FIG. 1 is a perspective view of a preferred embodiment of the reflector from an angle that looks up and into the conical polyhedron without a light-stick in operating position.

10 large aperture
12 point end
14 facet edge
16 facet surface
18 light-stick
20 encircling band
22 slit stop
24 slit

DESCRIPTION—FIGS. 1 to 4

FIG. 1 shows a perspective view of a preferred embodiment of the reflector. The reflector is a conical polyhedron. The polyhedron is tapered from a large aperture 10 to a point end 12. In the preferred embodiment, the reflector is made from a sheet of thin flexible material of predetermined thickness. The sheet of material is laminated on the exterior surface with a clear plastic film and on the interior surface with a chrome-mirrored highly reflective plastic film. The plastic films are of the type of MYLAR by Dow Corporation of Wilmington, Del. and ScotchCal by the 3M corporation of St. Paul, Minn. However, the reflector can consist of any reflective colors and materials that can be repeatedly bent without fracturing or separating.

The body of the reflector consists of a plurality of facets 16. Facets 16 are triangular in shape. The combined bases of facets 16 form large aperture 10. The combined vertices of facets 16 form point end 12. Facets 16 provide an outside surface for imprinting directions and information. Facets 16 provide an inside surface that can be covered with any number of reflective materials and reflective colors.

The diameter of large aperture 10 is typically fifty millimeters to two hundred fifty millimeters (two inches to ten inches). The length of the reflector (from point end 12 to large aperture 10) is typically one hundred millimeters to five hundred millimeters (four inches to twenty inches). A plurality of facet edges 14 extends from large aperture 10 to point end 12. Facet edges 14 create the articulating folding quality of the reflector. Articulated, flexible facet edges 14 allow two-way foldability that can be used to create compact packaging and storage for the reflector.

Figure 2:
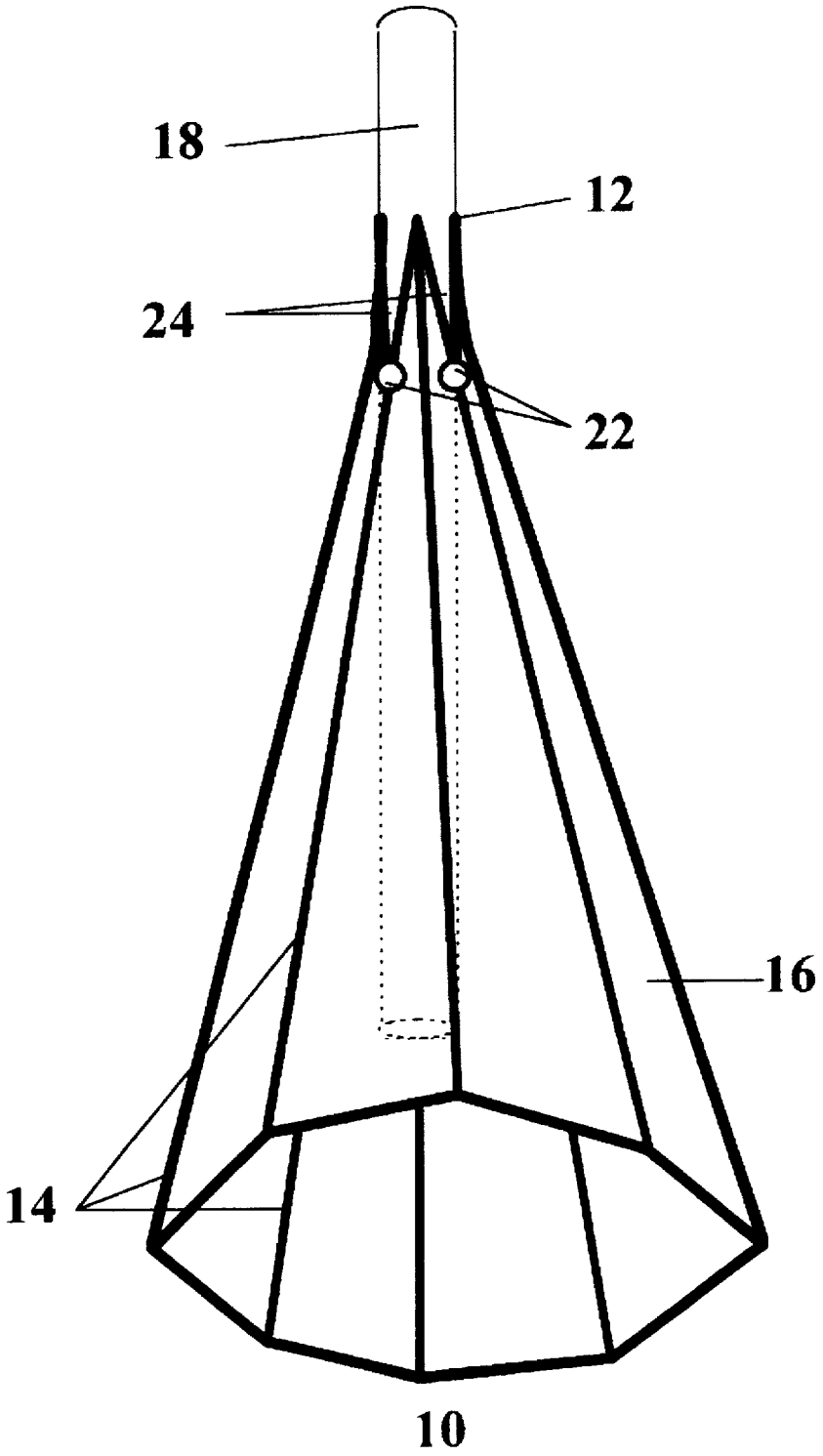
FIG. 2 is a perspective view of a preferred embodiment of the reflector from an angle that looks up and into the conical polyhedron with a light-stick in operating position.

FIG. 2 includes all the properties and attributes shown in FIG. 1. FIG. 2 shows a plurality of short slits 24 made along the intersections of adjacent facets 16 at point end 12. FIG. 2 also shows point end 12 with short slits 24 expanded along facet edges 14. Short slits 24 are an insertion means that allow a light-stick 18 to enter into point end 12. Short slits 24 are a holding means that allow light-stick 18 to push through point end 12 thereby causing friction to hold light-stick 18 in position. FIG. 2 shows a plurality of slit stops 22 that prevent the unintended lengthening of short slits 24 and that also prevents the undesired separation of facets 16.

Figure 3:
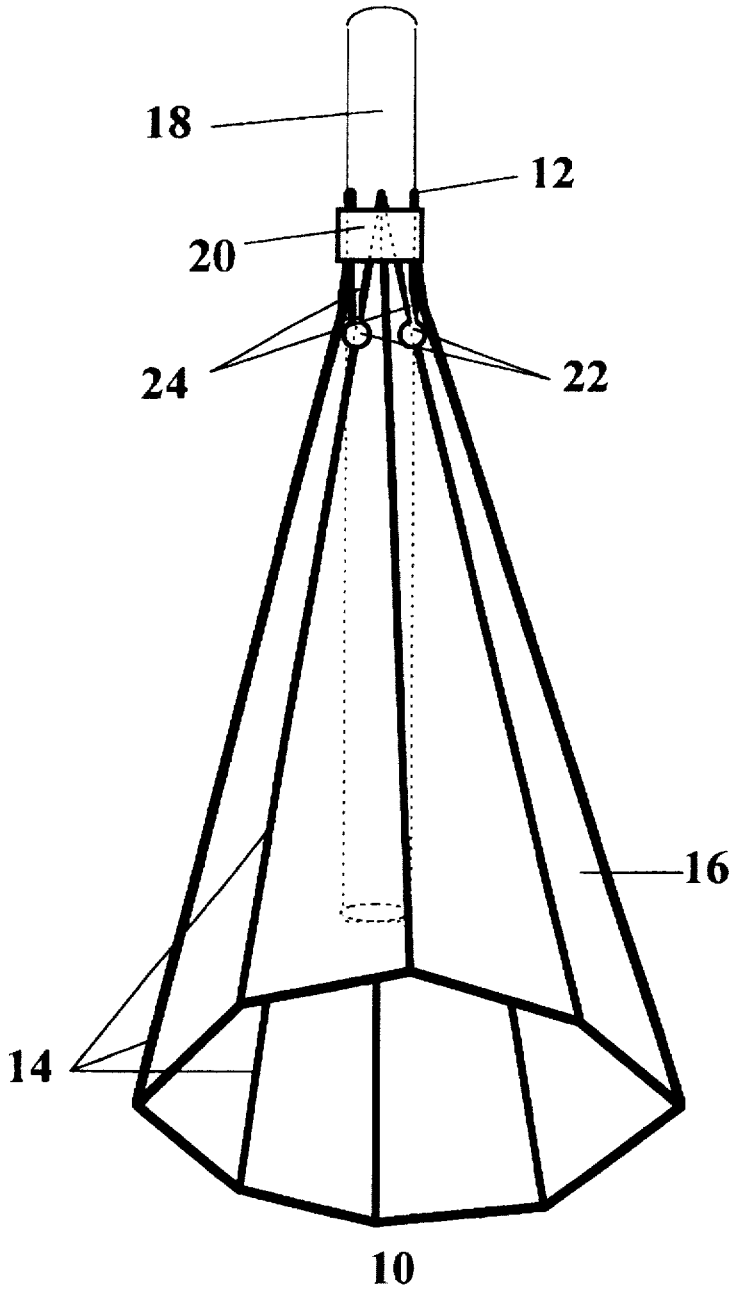
FIG. 3 is a perspective view of a preferred embodiment of the reflector from an angle that looks up and into the conical polyhedron with a light-stick in operating position and an encircling band enhancing the holding means.
Figure 4:
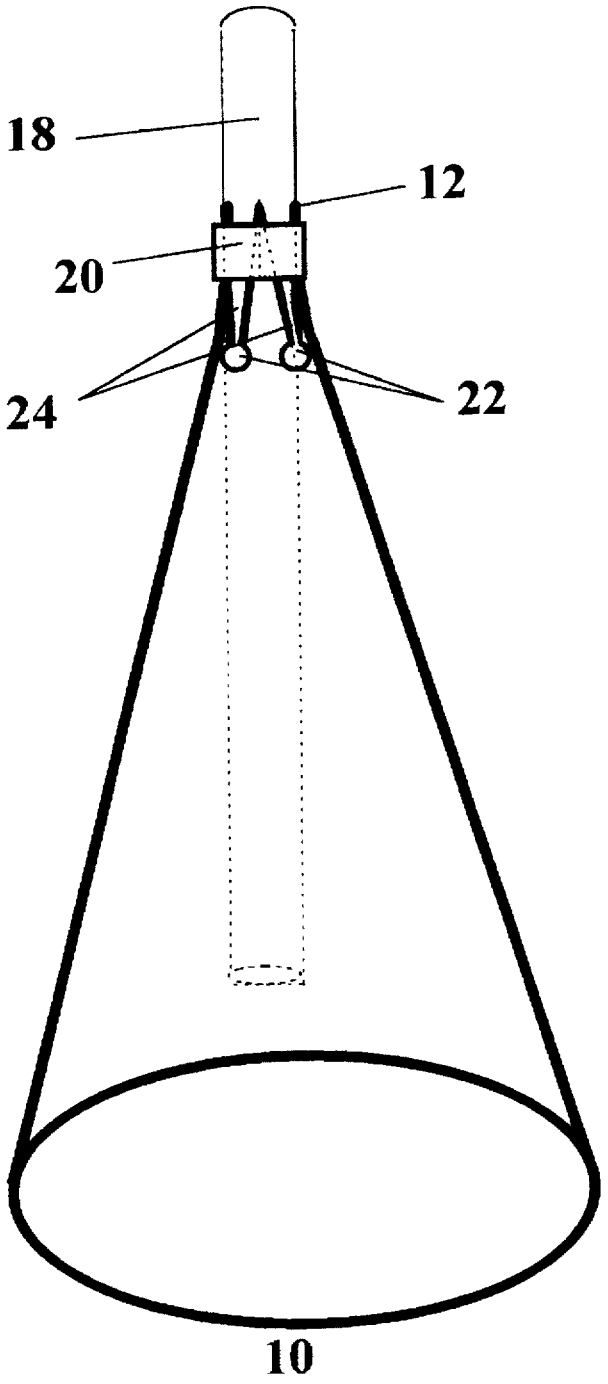
FIG. 4 is a perspective view of another preferred embodiment of a conical reflector with a light stick in operating position and an encircling band enhancing the holding means.

FIG. 3 includes all the properties and attributes shown in FIG. 1 and FIG. 2. Point end 12 holds light-stick 18 in position inside the reflector. The holding means is provided by the frictional properties of the construction materials and short slits 24. Additional holding means is supplied by an encircling band 20 placed around point end 12 of the reflector and light-stick 18 as shown in FIG. 3. FIG. 4 shows a conical reflector having all the properties and attributes shown in FIG. 1 and FIG. 2 except without the facets and having point end 12 holding light stick 18 in position inside the reflector. The holding means is provided by the frictional properties of the construction materials and short slits 24. Additional holding means is supplied by an encircling band 20 placed around the point end of the reflector and light stick 18 as shown in FIG. 4.

Opposite point end 12 is large aperture 10. Light-stick 18, positioned inside the reflector, emits light against the reflective interior surfaces of facets 16. The angular form of the reflector forces the light towards large aperture 10. Large aperture 10 allows concentrated light from the reflector to travel in one general direction. This allows the reflector to be pointed at and to illuminate an object or area as would be done by an electric flashlight.

OPERATION—FIGS. 1 to 4

The manner of using the reflector will usually be related to the use of a commercially available light-stick 18. After activating light-stick 18 according to the manufacturer's instructions, the reflector is manipulated to the shape shown in FIG. 1. Activated light-stick 18 is passed through large aperture 10 and forced into and through point end 12 of the reflector. Light-stick 18 is held in place by the materials of the reflector as shown in FIG. 2. An additional encircling band 20 can be utilized to hold light-stick 18 in position as shown in FIG. 3.

The combination of light-stick 18 and reflector is now operating. The reflector can be handheld, placed on a surface, attached to another object, and suspended from another object.

SUMMARY, RAMIFICATIONS, AND SCOPE

Accordingly, the reader will see that the reflector can be used to concentrate and direct light emitting from a light-stick. Furthermore, the reflector has the following additional advantages in that:

- it permits use with no risk of combustibility and electrical shock;
- it permits use and re-use by replacing a spent light-stick with a new light-stick;
- it permits long-term storage of a light-stick and a reflector;
- it permits storage in a flexible, foldable, compact manner;
- it permits mobile use and stationary use;
- it permits important information to be imprinted onto the facets;
- it permits brightly colored materials to be used for identification.

Although the description above contains many specifications, these should not be construed as limiting the scope of the reflector but as merely providing illustrations of some of the presently preferred embodiments of the reflector.

For example,

- the reflector can have other shapes such as completely conical;
- the materials and colors can be more reflective or less reflective;
- the facets can be trimmed to alter their shape;
- the holding means can be modified to enhance holdability.

Thus the scope of the reflector should be determined by the appended claims and their legal equivalents, rather than by the examples given.

We claim:

1. A light reflector comprising:

(a) a plurality of connected adjacent facets, each of said facets having a base at one end and a vertex at an opposite end, the bases of said facets defining a first aperture, and the vertices of said facets forming a point end and defining a second aperture, (b) a tubular, chemiluminescent light-stick having a top and a bottom, which emits light after being activated, and (c) slits means formed along intersections of adjacent facets at said point end allowing said light-stick inserted into said light reflector through said first aperture and (d) a holding means of said slits means for holding said light-stick in a predetermined position relative to said light reflector, (e) whereby a human can hold, manipulate and position said light reflector.

2. The light reflector as recited in claim 1 wherein the reflector is a polyhedron shape.

3. The light reflector as recited in claim 2 wherein the shape of the reflector is a conical polyhedron.

4. The light reflector as recited in claim 1 wherein an interior surface of each of the facets is made of a highly reflective material.

5. The light reflector as recited in claim 1 wherein an interior surface of each of the facets is made of a highly reflective color.

6. The light reflector as recited in claim 1 wherein the facets are made of a flexible material of predetermined thickness.

7. The light reflector as recited in claim 1 wherein the facets are made of a flexible material and movable with respect to adjacent facets.

8. The light reflector as recited in claim 1 wherein an exterior surface of at least one facet is imprinted with information.

9. The light reflector as recited in claim 1 wherein a length of the reflector is from one hundred millimeters to five hundred millimeters.

10. The light reflector as recited in claim 1, wherein a width of the first aperture of the reflector is from fifty millimeters to two hundred fifty millimeters.

11. The light reflector as recited in claim 1 wherein the holding means is enhanced by including an encircling band encircling the second aperture and the light stick.

12. A light reflector comprising:

(a) a conical polyhedron composed of a plurality of connected adjacent, flexible facets, each of said facets having a base at one end and a vertex at an opposite end, the bases of said facets defining a first aperture, and the vertices of said facets forming a point end and defining a second aperture, (b) a tubular, chemiluminescent light-stick having a top and a bottom, which emits light after being activated, and (c) a said light-stick inserted into said light reflector through said first aperture, and (d) a holding means of said slits means for holding said light-stick in a predetermined position relative to said light reflector, and (e) a plurality of interior surfaces of said facets covered with a highly reflective material, and (f) whereby said plurality of facets are moveable with respect to adjacent facets through bending, and (g) a plurality of exterior surfaces of said facets are imprinted, (h) whereby a human can hold, manipulate and position said light reflector.

13. The light reflector as recited in claim 12 wherein a length of the reflector is from one hundred millimeters to five hundred millimeters.

14. The light reflector as recited in claim 12 wherein a width of the first aperture of the reflector is from fifty millimeters to two hundred fifty millimeters.

15. The light reflector as recited in claim 12 wherein the holding means is enhanced by including an encircling band encircling the second aperture and the light stick.

16. A light reflector comprising:

(a) a conical shape light reflector having a first aperture at one end and a point end with a second aperture at an opposite end and (b) a tubular, chemiluminescent light-stick having a top end and a bottom end, which emits light after being activated, and (c) slits means formed along the point end of said reflector allowing said light-stick inserted into said light reflector through the first aperture, and (d) a holding means of said slits means for holding said light-stick in a predetermined position relative to said light reflector, and (e) an interior surface of said reflector covered with a highly reflective material, and (f) exterior surface of said reflector is imprinted with information, (g) whereby a human can hold, manipulate and position said light reflector.

17. The light reflector as recited in claim 16 wherein a length of the reflector is from one hundred millimeters to five hundred millimeters.

18. The light reflector as recited in claim 16 wherein a width of the first aperture of the reflector is from fifty millimeters to two hundred fifty millimeters.

19. The light reflector as recited in claim 16 wherein the holding means is enhanced by including an encircling band encircling the slits means and the light stick.

* * * * *